US011912522B2

(12) United States Patent
Miyachi

(10) Patent No.: US 11,912,522 B2
(45) Date of Patent: Feb. 27, 2024

(54) DISCHARGE UNIT

(71) Applicant: RISO KAGAKU CORPORATION, Tokyo (JP)

(72) Inventor: Ryosuke Miyachi, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 26 days.

(21) Appl. No.: 16/823,966

(22) Filed: Mar. 19, 2020

(65) Prior Publication Data

US 2020/0307940 A1 Oct. 1, 2020

(30) Foreign Application Priority Data

Mar. 29, 2019 (JP) ..... 2019-067369

(51) Int. Cl.
*B65H 29/52* (2006.01)

(52) U.S. Cl.
CPC ..... *B65H 29/52* (2013.01); *B65H 2301/4212* (2013.01)

(58) Field of Classification Search
CPC ..... B65H 29/52; B65H 2301/4212
See application file for complete search history.

(56) References Cited

U.S. PATENT DOCUMENTS 5,791,642 A * 8/1998 Sawano ..... B65H 31/02 270/58.01
6,095,516 A 8/2000 Sawano et al.
7,395,026 B2 * 7/2008 Seo ..... G03G 15/6552 271/278
7,748,705 B2 7/2010 Yamada
9,975,714 B2 * 5/2018 Hirata ..... B65H 31/24
2006/0017219 A1 1/2006 Yamada
2008/0067737 A1 * 3/2008 Kosuda ..... B65H 31/02 271/207
2011/0222944 A1 9/2011 Tanaka et al.
2013/0075969 A1 3/2013 Akiyama
(Continued)

FOREIGN PATENT DOCUMENTS

CN 1721307 1/2006
CN 102190192 9/2011
CN 103030016 4/2013
CN 104097966 10/2014
(Continued)

OTHER PUBLICATIONS

Office Action, Chinese Patent Office, in counterpart Chinese application No. 202010208248.2, dated Jul. 6, 2021, with English translation.
(Continued)

*Primary Examiner* — Howard J Sanders
(74) *Attorney, Agent, or Firm* — GREENBLUM & BERNSTEIN, P.L.C.

(57) ABSTRACT

A discharge tray for loading thereon sheets to be discharged at a predetermined discharge angle by a discharge roller pair is provided. The discharge tray includes a loading surface provided at a predetermined first inclination angle with respect to a discharge direction of a sheet by the discharge roller pair so that a top of the sheet discharged by the discharge roller pair comes into contact with the loading surface, and a guide unit provided on the loading surface at a second inclination angle with respect to the loading surface so as to partially lift up the loaded sheet from the loading surface.

15 Claims, 6 Drawing Sheets

(56) References Cited

U.S. PATENT DOCUMENTS

| | | | | |
|---|---|---|---|---|
| 2013/0307211 | A1* | 11/2013 | Morita | B65H 31/00 271/207 |
| 2014/0300044 | A1 | 10/2014 | Kainuma | |
| 2014/0300048 | A1* | 10/2014 | Nakamura | B65H 31/20 271/209 |
| 2014/0321877 | A1* | 10/2014 | Ono | B65H 31/02 399/92 |
| 2015/0274472 | A1* | 10/2015 | Momiyama | B65H 29/14 271/207 |
| 2016/0154358 | A1* | 6/2016 | Hashimoto | B65H 31/20 271/213 |
| 2017/0121145 | A1 | 5/2017 | Otsuka et al. | |
| 2018/0097961 | A1 | 4/2018 | Morita et al. | |

FOREIGN PATENT DOCUMENTS

| | | |
|---|---|---|
| CN | 106629200 | 5/2017 |
| CN | 107888794 | 4/2018 |
| JP | 9-156818 | 6/1997 |
| JP | 2000-313561 | 11/2000 |
| JP | 2006-27758 | 2/2006 |
| JP | 2010-18428 | 1/2010 |

OTHER PUBLICATIONS

Japanese Official Action, Japan Patent Office, in counterpart Japanese Application No. 2019-067369, dated Dec. 6, 2022 (with English translation).

Japanese Official Action, in counterpart Japanese Patent Application No. 2019-067369, dated Feb. 14, 2023 (with English translation).

* cited by examiner

DISCHARGE UNIT

TECHNICAL FIELD

The present invention relates to a discharge unit that prevents paper jam of a sheet to be discharged.

RELATED ART

In a general image processing device, printed sheets are discharged to a discharge tray. At this time, it is desired that the discharged sheets are placed on the discharge tray in an aligned state.

Patent Literature 1 (Japanese Patent Application Publication No. 2006-27758) discloses a technique relating to a sheet discharge tray provided with different inclinations to have an excellent sheet stacked amount.

However, according to the technique disclosed in Patent Literature 1, when tall optional equipment is connected to the discharge tray side, while maintaining a discharge tray angle, it is necessary to set a width of an intermediate part connecting the optional equipment and a body to be long. As a result, an area of occupancy of the entire device including the optional equipment increases.

Therefore, to suppress the width of the optional equipment, an angle of the discharge tray needs to be increased (needs to be approximated to be vertical).

If the angle of the discharge tray is increased, a discharged sheet and loaded sheets come into contact with each other before a rear end of the sheet passes through a discharge port, and those sheets adsorb each other due to a frictional force and static electricity between the sheets, to lose energy applied by discharging means. Therefore, the rear end of the discharged sheet cannot pass over the discharge port and is caught thereby. Further, even if a discharge angle is matched with the angle of the discharge tray so that the discharged sheet does not come into contact with the stacked sheets, it is necessary to eject the sheet against a gravity force. Therefore, the energy applied by the discharging means decreases to cause a similar problem.

In this manner, there is a problem that the sheets adsorb each other due to friction and static electricity between sheets to decrease the discharging energy, and as a result, the rear end of a sheet remains in the discharge port and is not discharged properly, and collides with a subsequent sheet to cause paper jam.

SUMMARY

In order to achieve the above object, the discharge unit according to the present embodiment is a discharge unit that loads a sheet to be discharged thereon along a loading surface, and the loading surface is provided at a predetermined first inclination angle with respect to the discharge direction, so that the top of the discharged sheet comes into contact with the loading surface. The discharge unit includes a guide unit provided on the loading surface at a second inclination angle with respect to the loading surface, so as to partially lift up the loaded sheet from the loading surface.

According to the characteristics of the discharge unit of the present invention, since a sheet is reliably discharged from a discharge port, an occurrence of paper jam due to a collision of the rear end of the sheet with a subsequent sheet in a state where the rear end is left in the discharge port can be prevented. Accordingly, the sheet can be discharged reliably.

BRIEF DESCRIPTION OF DRAWINGS

The invention will now be described with reference to the accompanying drawings wherein.

DETAILED DESCRIPTION

Figure 1:
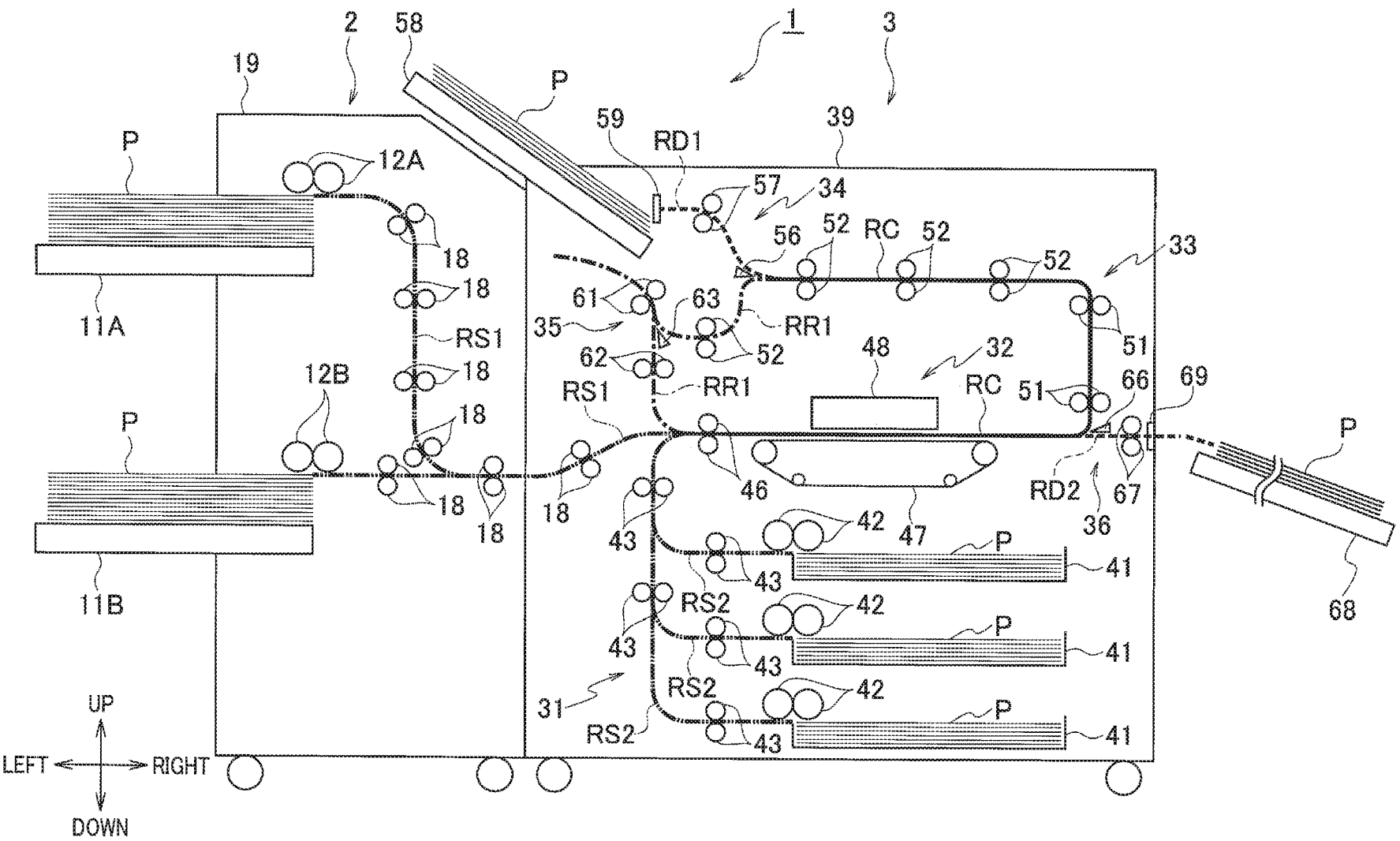
FIG. 1 is a schematic configuration diagram of a printing device according to a first embodiment of the present invention.

Embodiments of the present invention will be described below with reference to the drawings. In the drawings, like or equivalent parts or constituent elements are denoted by like or equivalent reference signs.

The following embodiments are only examples illustrating a device or the like for realizing the technical ideas of the present invention, and in the technical ideas of the invention, materials, forms, structures, arrangements, and the like of respective component parts are not limited to those in the embodiments described below. The technical ideas of the present invention can be variously modified within the scope of claims.

First Embodiment

FIG. 1 is a schematic configuration diagram of a printing device according to a first embodiment of the present invention. In the following descriptions, a direction orthogonal to a drawing in FIG. 1 is designated as a front-back direction. Further, right and left and up and down on the drawing in FIG. 1 are designated as horizontal and vertical directions, respectively.

In FIG. 1, a route indicated by a thick line is a transport route on which a sheet P being a print medium is transported. A route indicated by a solid line of the transport route is a common route RC. Routes indicated by a broken line are discharge routes RD1 and RD2. A route indicated by a dashed-dotted line is a reverse route RR1. Routes indicated by a dashed-two dotted line are an external feeding route RS1, and inner feeding routes RS2, respectively. "Upstream" and "downstream" in the following descriptions respectively mean an upstream and a downstream in a transport route.

As illustrated in FIG. 1, a printing device 1 according to the first embodiment includes an external feeding unit 2 and a printing device body 3.

The external feeding unit 2 feeds sheets P to a printing unit 32 in the printing device body 3 described later. The external feeding unit 2 includes external feed trays 11A and 11B, external feeding roller pairs 12A and 12B, a plurality of external feeding-transport roller pairs 18, and an external feeding unit housing 19 that stores or holds respective portions of the external feeding unit 2. Alphabet suffixes in reference signs such as the external feed trays 11A and 11B may be omitted and the reference signs are written collectively.

The external feed tray 11 is for loading thereon sheets P to be used for printing. The external feed trays 11A and 11B are arranged in parallel in a vertical direction. The external feed tray 11B is arranged below the external feed tray 11A. The external feed trays 11A and 11B are selectively used as a feeding source to the printing unit 32.

The external feeding roller pairs 12A and 12B are rotationally driven by a motor (not illustrated) to come in pressure contact with the top (uppermost side) sheet P of the sheets P loaded on the external feed tray 11, take out the sheet P by the frictional force, and transport the sheet P to the external feeding route RS1.

The external feeding-transport roller pairs 18 transport the sheet P taken out by the external feeding roller pairs 12A and 12B toward a registration roller pair 46 in the printing device body 3 described later. The external feeding-transport roller pairs 18 are arranged along the external feeding route RS1. A pair of external feeding-transport roller pairs 18 are arranged in a body housing 39 of the printing device body 3 described later. The external feeding-transport roller pairs 18 are rotationally driven by a motor (not illustrated).

The printing device body 3 performs printing on a sheet P. The printing device body 3 includes an internal feeding unit 31, a printing unit 32, an upper-surface transport unit 33, a first discharge unit 34, a reverse unit 35, a second discharge unit 36, and the body housing 39 that stores or holds the respective units in the printing device body 3.

The internal feeding unit 31 feeds sheets P to the printing unit 32 inside the printing device body 3. The internal feeding unit 31 includes a plurality of internal feed trays 41, a plurality of internal feeding roller pairs 42, and a plurality of internal feeding-transport roller pairs 43.

The internal feed trays 41 are for loading thereon sheets P to be used for printing. The internal feed trays 41 are arranged inside the body housing 39.

The internal feeding roller pair 42 takes out a sheet P from the internal feed tray 41 and feeds the sheet P to the inner feeding route RS2. The internal feeding roller pairs 42 are rotationally driven by a motor (not illustrated).

The internal feeding-transport roller pair 43 transports the sheet P taken out from the internal feed tray 41 toward the registration roller pair 46 described later. The internal feeding-transport roller pairs 43 are arranged along the inner feeding route RS2. The internal feeding-transport roller pairs 43 are rotationally driven by a motor (not illustrated).

The printing unit 32 prints an image on a sheet P, while transporting the sheet P. The printing unit 32 includes the registration roller pair 46, a belt platen 47, and an ink jet head 48.

The registration roller pair 46 once stops the sheet P transported from any of the external feeding unit 2, the internal feeding unit 31, and the reverse unit 35 to perform skew correction, and then transports the sheet P toward the belt platen 47. The registration roller pair 46 is arranged on the common route RC near a merging point of the external feeding route RS1, the internal feeding route RS2, and the reverse route RR1. The registration roller pair 46 is rotationally driven by a motor (not illustrated).

The belt platen 47 transports the sheet P transported from the registration roller pair 46 by adsorptive retention of the sheet P on the belt.

The ink jet head 48 has a line-type ink jet head (not illustrated) in which a plurality of nozzles are arrayed in a direction substantially orthogonal to the transport direction of the sheet P (in the front-back direction). The ink jet head 48 is arranged above the belt platen 47. The ink jet head 48 prints an image on the sheet P transported by the belt platen 47 by discharging ink from the ink jet head.

The upper-surface transport unit 33 transports the sheet P transported by the belt platen 47 from the right to the left so as to U-turn. The upper-surface transport unit 33 includes a plurality of upward transport roller pairs 51 and a plurality of horizontal transport roller pairs 52.

The upward transport roller pairs 51 transport the sheet P transported by the belt platen 47 to the horizontal transport roller pairs 52 above thereof. The upward transport roller pairs 51 are arranged along an ascending portion in a middle-stream region of the common route RC. The upward transport roller pairs 51 are rotationally driven by a motor (not illustrated).

The horizontal transport roller pairs 52 transport the sheet P transported by the upward transport roller pairs 51 to the first discharge unit 34 or the reverse unit 35. The horizontal transport roller pair 52 on the most downstream side is arranged along an upstream portion of the reverse route RR1. Other horizontal transport roller pairs 52 are arranged along a horizontal portion in a downstream region of the common route RC. The horizontal transport roller pairs 52 are rotationally driven by a motor (not illustrated).

The first discharge unit 34 discharges the sheet P printed by the printing unit 32. The first discharge unit 34 includes a switching unit 56, a discharge roller pair 57, and a discharge tray 58.

The switching unit 56 switches the transport route of the sheet P between the discharge route RD1 and the reverse route RR1. The switching unit 56 is arranged at a branch point between the discharge route RD1 and the reverse route RR1.

The discharge roller pair 57 transports the sheet P guided to the discharge route RD1 by the switching unit 56 and discharges the sheet P obliquely upward to the discharge tray 58 at a discharge angle. The discharge roller pair 57 is arranged between the switching unit 56 and the discharge tray 58 along the discharge route RD1. The discharge roller pair 57 is rotationally driven by a motor (not illustrated).

The printed sheet P discharged from a discharge port 59 by the discharge roller pair 57 is loaded on the discharge tray 58.

A downstream end of the discharge tray 58 is located above the external feeding unit housing 19. The external feeding unit 2 needs to be downsized in the horizontal direction for space saving. To secure a space for arranging the respective constituent components provided in the external feeding unit 2, the discharge tray 58 is provided inclining to have a steep gradient with respect to a horizontal plane (in the front-back and right-left directions). Detailed configurations of the discharge tray 58 are described later.

The reverse unit 35 reverses and transports the surface-printed sheet P to the registration roller pair 46. The reverse unit 35 includes a reverse roller pair 61, a refeeding roller pair 62, and a switching gate 63.

The reverse roller pair 61 switches back and transports the sheet P transported by the horizontal transport roller pairs 52 of the upper-surface transport unit 33 to the refeeding roller pair 62. The reverse roller pair 61 is configured so as to be able to perform forward and reverse rotations in order to perform switch-back transport of the sheet P. The reverse roller pair 61 is arranged between the horizontal transport roller pair 52 on the most downstream side and the refeeding roller pair 62 along the reverse route RR1 The reverse roller pair 61 is rotationally driven by a motor (not illustrated).

The refeeding roller pair 62 transports the sheet P switched back by the reverse roller pair 61 to the registration roller pair 46. The refeeding roller pair 62 is arranged between the reverse roller pair 61 and the registration roller pair 46 along the reverse route RR1. The refeeding roller pair 62 is rotationally driven by a motor (not illustrated).

The switching gate 63 guides the sheet P transported by the horizontal transport roller pair 52 to the reverse roller pair 61. Further, the switching gate 63 guides the sheet P switched back by the reverse roller pair 61 to the refeeding roller pair 62. The switching gate 63 is arranged near the gravity center of three points of the horizontal transport roller pair 52 on the most downstream side, the reverse roller pair 61, and the refeeding roller pair 62.

The second discharge unit 36 discharges the sheet P printed by the printing unit 32. The second discharge unit 36 includes a switching unit 66, a discharge roller pair 67, and a discharge tray 68.

The switching unit 66 switches the transport route of the sheet P between the common route RC and the discharge route RD2. The switching unit 66 is arranged at a branch point between the common route RC and the discharge route RD2.

The discharge roller pair 67 transports the sheet P guided to the discharge route RD2 by the switching unit 66 and discharges the sheet P obliquely downward to the discharge tray 68 at a discharge angle. The discharge roller pair 67 is arranged between the switching unit 66 and the discharge tray 68 along the discharge route RD2. The discharge roller pair 67 is rotationally driven by a motor (not illustrated).

The printed sheets P discharged from the discharge port 69 by the discharge roller pair 67 are loaded on the discharge tray 68.

Figure 2:
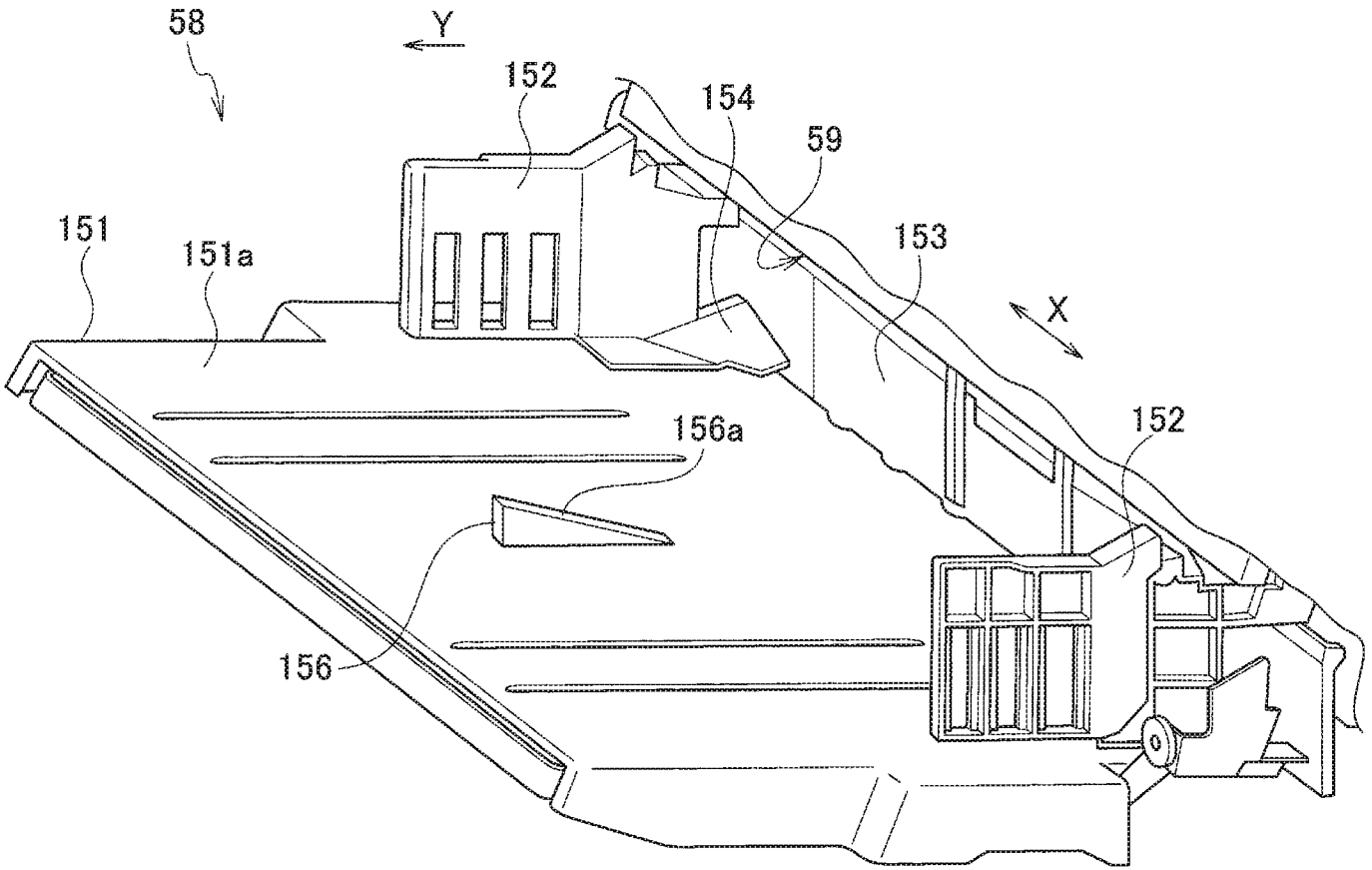
FIG. 2 is a perspective view illustrating a discharge tray provided in the printing device according to the first embodiment of the present invention.
Figure 3:
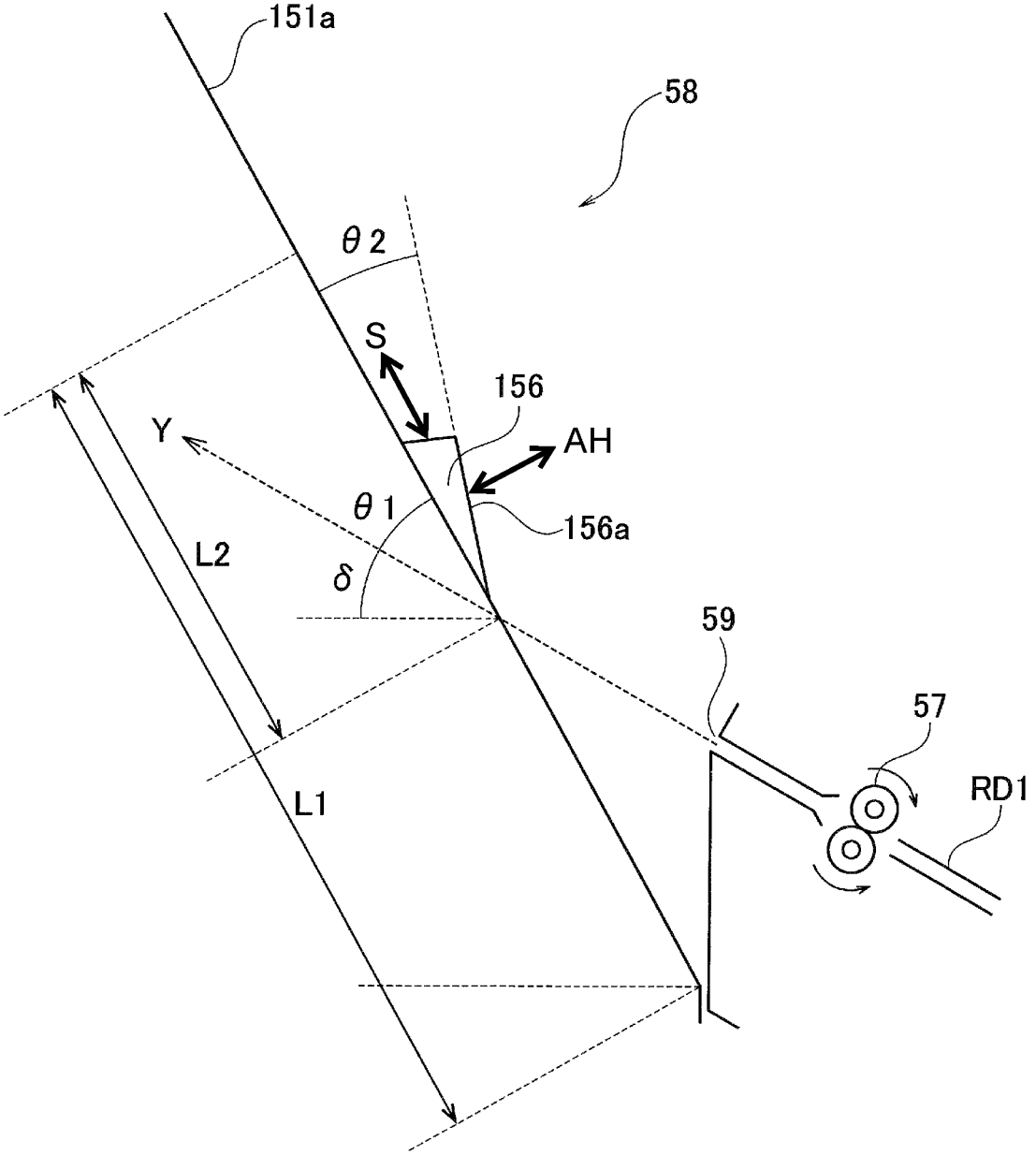
FIG. 3 is a side view schematically illustrating an attached state of the discharge tray provided in the printing device according to the first embodiment of the present invention.

FIG. 2 is a perspective view illustrating the discharge tray 58 provided in the printing device 1 according to the first embodiment of the present invention. FIG. 3 is a side view schematically illustrating an attached state of the discharge tray 58.

As illustrated in FIG. 2, the discharge tray 58 according to the present embodiment is for stacking thereon sheets P printed by the printing device 1 and discharged from the discharge port 59.

The discharge tray 58 is provided at the discharge port 59, which is continuous to the discharge route RD1, and includes a tray body 151, a pair of side fences 152 and 152, a bump cover 153, and a pair of stiffening members 154 and 154.

Sheets P are transported on the discharge route RD1, and discharged from the discharge port 59 obliquely upward toward a Y direction. An angle of a discharge direction (the Y direction) of the sheet P with respect to the horizontal plane is referred to as "discharge angle δ".

The discharge tray 58 is provided at a dropping position of the sheet P discharged from the discharge port 59. The discharge tray 58 includes a tray body 151 having a loading surface 151*a*. The tray body 151 is a cradle for loading sheets P on the loading surface 151*a*. Sheets P sequentially discharged from the discharge port 59 are placed on the loading surface 151*a* in a stacked state.

The loading surface 151*a* is provided at a first inclination angle θ1 with respect to the discharge direction (the Y direction) of the sheets P. Accordingly, the top of the sheet P discharged from the discharge port 59 in the Y direction collides with the loading surface 151*a*.

A guide unit 156 is provided near a collision position on the loading surface 151*a*, for example, on a downstream side of the collision position, and on an upstream side of a top position of a sheet P having a maximum size loaded on the discharge tray 58. Specifically, when it is assumed that a length of the sheet P having the maximum size loaded on the discharge tray 58 is L1 illustrated in FIG. 3, the guide unit 156 is provided in a distance L2 between the collision position of the sheet P and the top position of the sheet P having the maximum size loaded on the discharge tray 58.

The guide unit 156 is a member having an inclined surface 156*a*. In the guide unit 156, the inclined surface 156*a* is provided at a second inclination angle θ2 with respect to the loading surface 151*a*, so as to partially lift up the loaded sheet P from the loading surface 151*a*. The second inclination angle θ2 is provided so that a sum of the discharge angle δ, the first inclination angle θ1, and the second inclination angle θ2 becomes less than 90 degrees. Further, the first inclination angle θ1 and the second inclination angle θ2 are each within 30 degrees.

Only one guide unit 156 is provided substantially at a central portion in a direction orthogonal to the discharge direction (the X direction) on the loading surface 151*a*, and in the discharge direction (the Y direction) of the sheet P.

The pair of side fences 152 and 152 is arranged respectively outside in a width direction X of the sheet P discharged from the discharge port 59 onto the loading surface 151*a* of the tray body 151, and provided relatively movably in the width direction X with respect to the tray body 151.

An interval between these side fences 152 and 152 can be set matched with the size of the sheet P and is normally slightly wider than the width of the discharged sheet P. The discharged sheet P enters between the pair of side fences 152 and 152, and the pair of side fences 152 and 152 regulate the width direction X of the sheet P to align the sheet.

Further, the stiffening members 154 and 154 are provided at the lowermost part of the pair of side fences 152 and 152. When the sheet P discharged to the discharge tray 58 moves on the loading surface 151*a* in the discharge direction Y, opposite portions of the sheet P in the width direction X respectively run onto the stiffening members 154. Accordingly, a curved portion is formed in the sheet P so that a middle of the sheet P in the width direction X is located at a position lower than the opposite ends, thereby increasing the stiffness of the sheet P in the discharge direction Y.

The bump cover 153 is provided, as illustrated in FIG. 2, at an upstream end of the tray body 151 in the discharge direction Y. The bump cover 153 is in a substantially erect plate shape. Since the sheet P discharged from the discharge port 59 returns backward in the discharge direction Y, while sliding on the loading surface 151*a* of the tray body 151 and an upstream end of the sheet P in the discharge direction Y bumps against the bump cover 153, the bump cover 153 aligns the discharge direction Y of the sheet P.

FIG. 4A to FIG. 4D, FIG. 5A and FIG. 5B are diagrams illustrating the state of a sheet P discharged to the discharge tray 58.

Figure 4A:
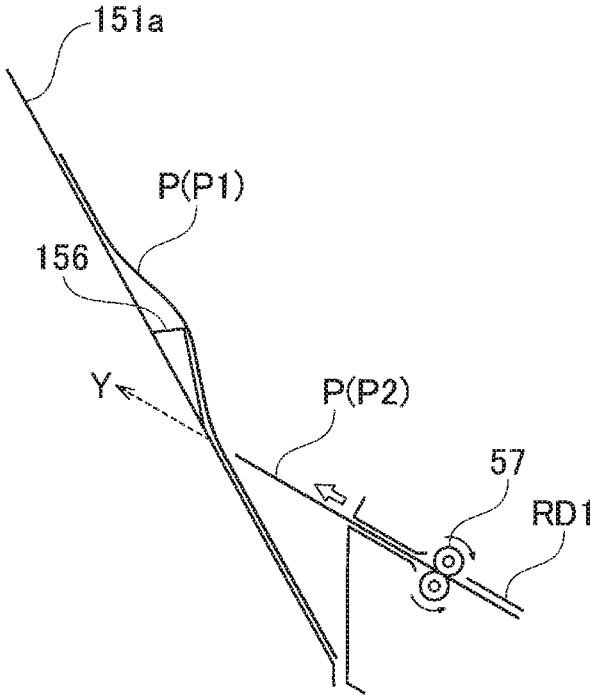
FIG. 4A is a diagram illustrating a state in which a sheet to be discharged to the discharge tray provided in the printing device according to the first embodiment of the present invention is transported.
Figure 4B:
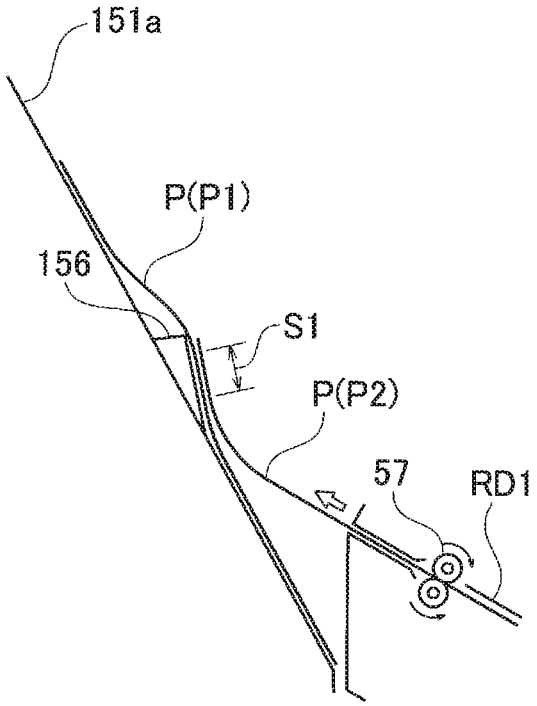
FIG. 4B is a diagram illustrating a state of the sheet to be discharged to the discharge tray provided in the printing device according to the first embodiment of the present invention after being transported further from the state illustrated in FIG. 4A.
Figure 4C:
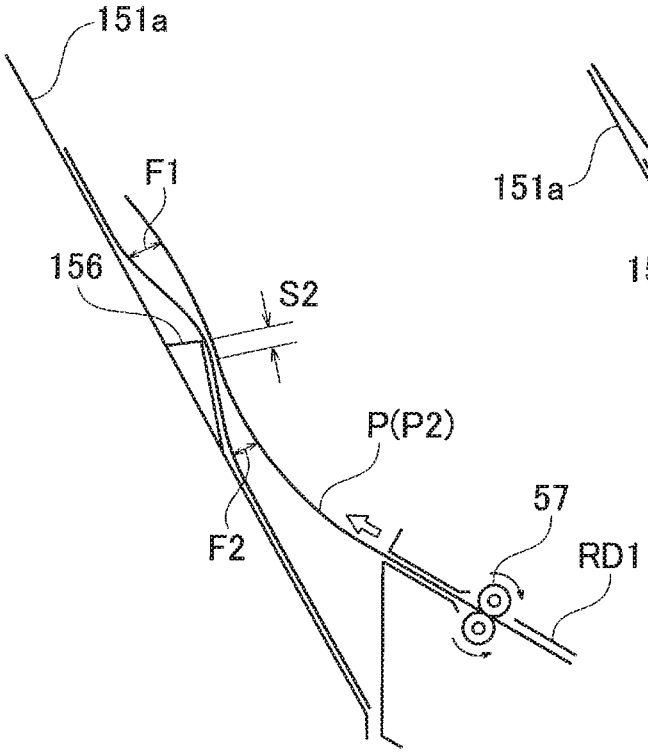
FIG. 4C is a diagram illustrating a state of the sheet to be discharged to the discharge tray provided in the printing device according to the first embodiment of the present invention after being transported further from the state illustrated in FIG. 4B.
Figure 4D:
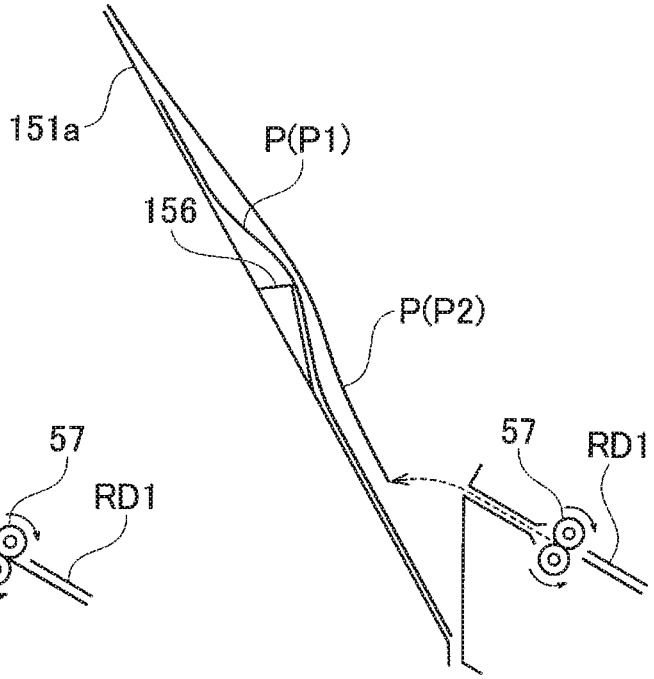
FIG. 4D is a diagram illustrating a state of the sheet to be discharged to the discharge tray provided in the printing device according to the first embodiment of the present invention after being transported further from the state illustrated in FIG. 4C.

FIG. 4A illustrates a state in which a sheet P to be discharged to the discharge tray 58 is transported. FIG. 4B illustrates a state of the sheet P after being transported further from the state illustrated in FIG. 4A. FIG. 4C illustrates a state of the sheet P after being transported further from the state illustrated in FIG. 4B. FIG. 4D illustrates a state of the sheet P after being transported further from the state illustrated in FIG. 4C.

Figure 5A:
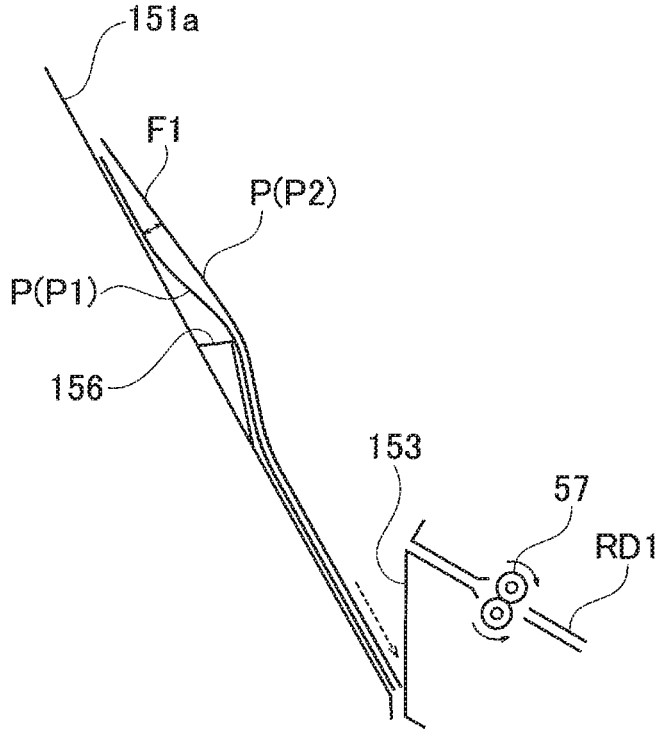
FIG. 5A is a diagram illustrating a state of a sheet discharged to the discharge tray provided in the printing device according to the first embodiment of the present invention.
Figure 5B:
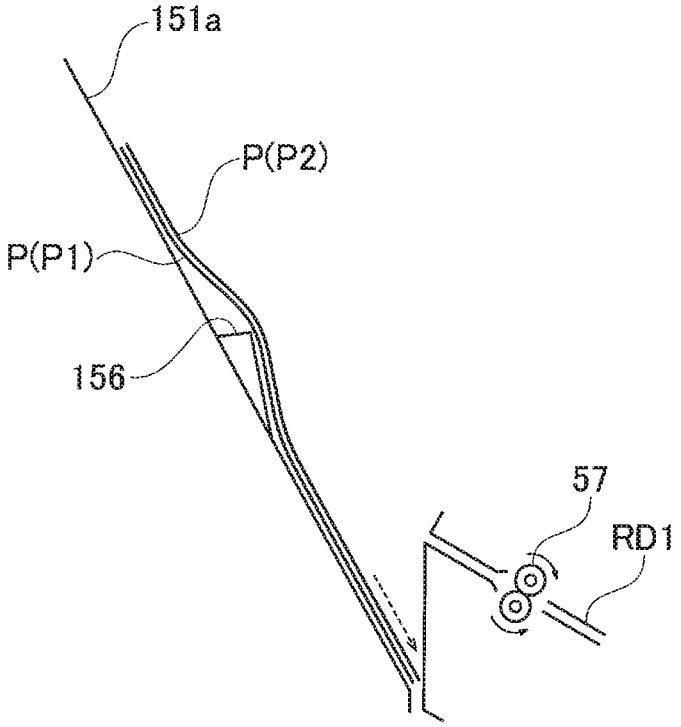
FIG. 5B is a diagram illustrating a state in which the sheet discharged to the discharge tray provided in the printing device according to the first embodiment of the present invention is loaded on a sheet placed on the loading surface, after the state illustrated in FIG. 5A.

FIG. 5A illustrates a state of a sheet P (P2) discharged to the discharge tray 58. FIG. 5B illustrates a state in which the sheet P (P2) discharged to the discharge tray 58 is loaded on a sheet P (P1) placed on the loading surface, after the state illustrated in FIG. 5A.

As illustrated in FIG. 4A, the sheet P (P1) discharged from the discharge port 59 is loaded on the loading surface 151*a* in the tray body 151. Since the guide unit 156 is provided on the loading surface 151*a*, a portion of the discharged sheet P (P1) coming into contact with the guide unit 156 is loaded in a state of being lifted up from the loading surface 151*a*.

The next sheet P (P2) is discharged from the discharge port 59 in the Y direction.

The sheet P (P2) discharged in the Y direction is continuously transported by the discharge roller pair 57 after the top thereof has come into contact with the sheet P (P1) placed on the loading surface 151*a*, and as illustrated in FIG. 4B, the sheet P (P2) is transported, while coming into contact with a portion of the sheet P (P1) lifted up by the guide unit 156 with a contact area S1.

When the sheet P (P2) is further transported by the discharge roller pair 57, as illustrated in FIG. 4C, the sheet P (P2) is transported, while coming into contact with a portion of the sheet P (P1) lifted up from the loading surface 151*a* by the guide unit 156 with a contact area S2 due to the stiffness of the sheet P (P2). At this time, the sheet P (P1) and the sheet P (P2) do not come into contact with each other outside the contact area S2, and a space F1 is formed on a downstream side thereof and a space F2 is formed on an upstream side thereof.

Accordingly, the contact area between the sheet P (P1) and the sheet P (P2) can be decreased, as compared with a case where the guide unit 156 is not formed on the loading surface 151*a*. Therefore, adsorption between the sheets P (P1 and P2) due to friction and static electricity between the sheets P (P1 and P2) can be prevented.

In this manner, the sheet P can be discharged reliably from the discharge port 59. Accordingly, it can be prevented that paper jam occurs because a subsequent sheet P (not illustrated) collides with the sheet P (P2) in a state where a rear end thereof is left in the discharge port 59, thereby enabling to discharge the sheet P reliably.

As illustrated in FIG. 4D, when the sheet P (P2) has passed the discharge roller pair 57, since the contact area between the sheet P (P1) and the sheet P (P2) can be decreased, the sheet P (P2) can easily slide down along the loading surface 151*a* toward the bump cover 153.

Therefore, as illustrated in FIG. 5A, the sheet P (P2) slides down until bumping against the bump cover 153 along the loading surface 151*a*, while keeping the space F1 between the sheet P (P1) and the sheet P (P2).

Thereafter, as illustrated in FIG. 5B, when the sheet P (P2) bumps against the bump cover 153, the air in the space F1 comes out and the sheet P (P2) is loaded on the sheet P (P1).

As described above, the discharge tray 58 provided in the printing device 1 according to the first embodiment of the present invention includes the loading surface 151*a* provided at the predetermined first inclination angle θ1 with respect to the discharge direction of a sheet P by the discharge roller pair 57 so that the top of the sheet P discharged by the discharge roller pair 57 comes into contact therewith, and the guide unit 156 provided on the loading surface 151*a* at the second inclination angle θ2 with respect to the loading surface 151*a*, so as to partially lift up the loaded sheet P from the loading surface 151*a*.

Therefore, since the next sheet P is loaded on the loading surface 151*a* in a state where the sheet P loaded on the discharge tray 58 is partially lifted up from the loading surface 151*a*, the contact area between the sheet P loaded on the discharge tray 58 and the newly discharged sheet P decreases. Accordingly, adsorption between the sheets P due to the friction and static electricity between the sheets P can be prevented. Therefore, since the sheet P is reliably discharged from the discharge port 59, an occurrence of paper jam due to a collision of the rear end of the sheet P with a subsequent sheet in a state where the rear end is left in the discharge port 59 can be prevented. Accordingly, the sheet P can be discharged reliably.

The guide unit 156 may be provided slidably in the discharge direction of the sheet P along the loading surface 151*a*, as shown by illustrative sliding arrow S in FIG. 3. Accordingly, when the sheet P has a large size, the guide unit 156 can be moved to a downstream side, and when the sheet P has a small size, the guide unit 156 can be moved to an upstream side. Accordingly, even if a sheet P of any size is discharged, the loaded sheet P can be partially lifted up from the loading surface 151*a*, and thus the contact area between the sheet P loaded on the discharge tray 58 and a newly discharged sheet P can be decreased.

The guide unit 156 may be provided in a state where a height thereof from the loading surface 151*a* is adjustable, as shown by illustrative adjustable height arrow AH in FIG. 3. Accordingly, the degree of partially lifting up a sheet P from the loading surface 151*a* can be adjusted according to the stiffness (non-flexibility) of the sheet P. Further, since the loaded sheet P can be partially lifted up from the loading surface 151*a*, regardless of the stiffness (non-flexibility) of the sheet P, the contact area between the sheet P loaded on the discharge tray 58 and a newly discharged sheet P can be decreased.

Further, although the discharge roller pair 57 discharges a sheet P obliquely upward to the discharge tray 58 at the discharge angle δ with respect to the horizontal plane, the discharge roller pair 67 can discharge a sheet P obliquely downward to the discharge tray 68 at the discharge angle δ with respect to a vertical plane.

Figure 6:
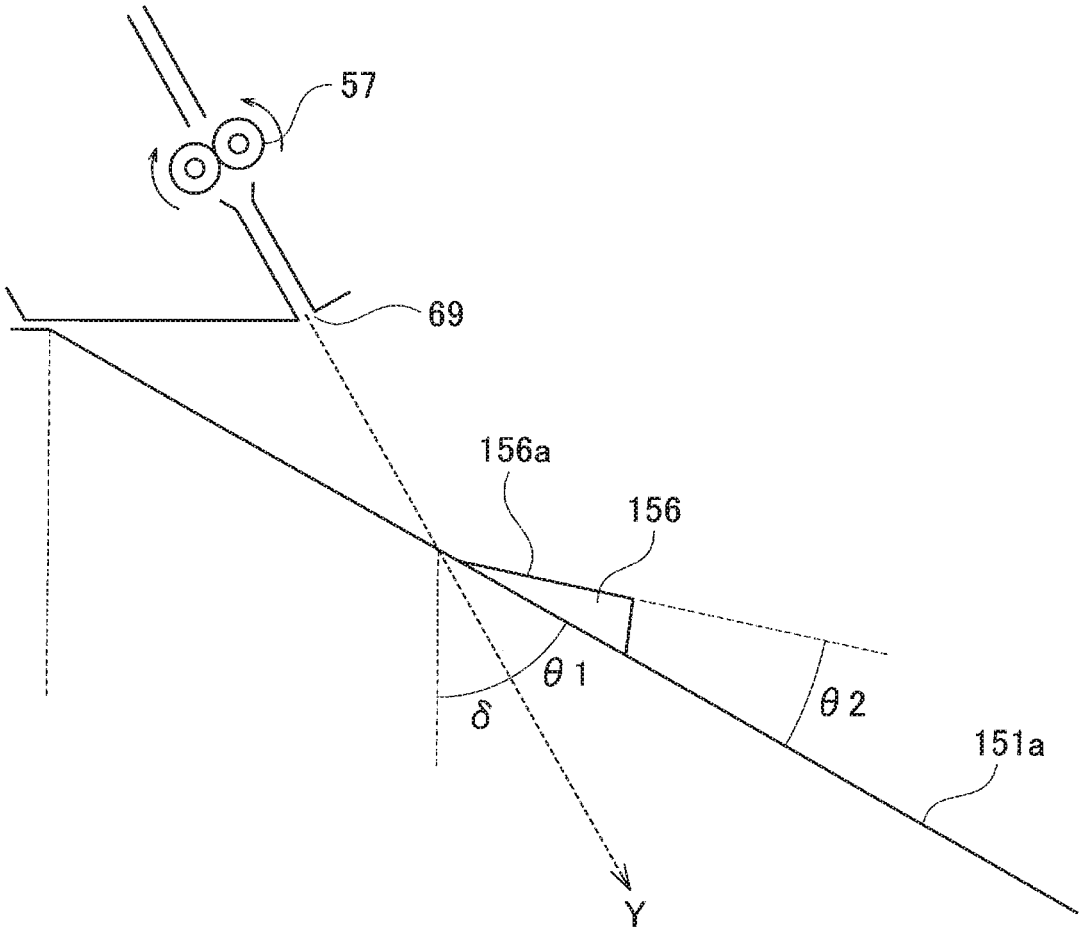
FIG. 6 is a side view schematically illustrating an attached state of a discharge tray provided in the printing device according to the first embodiment of the present invention.

FIG. 6 is a side view schematically illustrating an attached state of the discharge tray 68.

As illustrated in FIG. 6, the discharge tray 68 according to the present embodiment is for loading thereon sheets P printed by the printing device 1 and discharged from the discharge port 69. The discharge tray 68 is provided in such a manner that a downstream end thereof protrudes from the printing device 1.

Configurations of the discharge tray 68 are the same as those of the discharge tray 58, and only the angle of arrangement is different from each other.

A sheet P is transported on the discharge route RD2 and discharged obliquely downward toward the Y direction from the discharge port 69. An angle in the discharge direction (the Y direction) of the sheet P with respect to the vertical plane (the front-back and up-down directions) is referred to as "discharge angle δ".

The discharge tray 68 is provided at a dropping position of the sheet P discharged from the discharge port 69. The discharge tray 68 includes a tray body 151 having a loading surface 151*a*. The tray body 151 is a cradle for loading sheets P on the loading surface 151*a*. Sheets P sequentially discharged from the discharge port 69 are placed on the loading surface 151*a* in a stacked state.

The loading surface 151*a* is provided at the first inclination angle θ1 with respect to the discharge direction (the Y direction) of the sheets P. Accordingly, the top of the sheet P discharged from the discharge port 69 in the Y direction collides with the loading surface 151*a*.

A guide unit 156 is provided on a downstream side of the collision position in the Y direction on the loading surface 151*a*.

The guide unit 156 is a member having an inclined surface 156*a*. In the guide unit 156, the inclined surface 156*a* is provided at the second inclination angle θ2 with respect to the loading surface 151*a*, so as to partially lift up the loaded sheet P from the loading surface 151*a*. The first inclination angle θ1 and the second inclination angle θ2 are each larger than 0 degree and within 30 degrees.

Only one guide unit 156 is provided substantially at a central portion in the direction orthogonal to the discharge direction (the X direction) on the loading surface 151*a*, and in the discharge direction (the Y direction) of the sheet P.

As described above, in the discharge tray 68 provided in the printing device 1 according to the first embodiment of the present invention, as in the discharge tray 58, the contact area between the sheet P loaded on the discharge tray 68 and a newly discharged sheet P decreases. Accordingly, adsorption between the sheets P due to the friction and static electricity between the sheets P can be prevented. Therefore, since the sheet P is reliably discharged from the discharge port 69, an occurrence of paper jam due to a collision of the rear end of the sheet P with a subsequent sheet in a state where the rear end is left in the discharge port 69 can be prevented. Accordingly, the sheet P can be discharged reliably.

In the first embodiment of the present invention, an example of the discharge tray 68 in which only one guide unit 156 is provided in the discharge direction (the Y direction) of the sheet P on the loading surface 151*a* has been described. However, the present invention is not limited thereto, and a plurality of guide units 156 may be provided in the discharge direction (the Y direction) of the sheet P.

When the plurality of guide units 156 are provided in the discharge direction (the Y direction) of the sheet P, there may be a case where the entire sheet P is lifted up from the loading surface 151*a* with respect to the transport direction according to the size of the sheet P (the length of the sheet in the transport direction). Meanwhile, by providing only one guide unit 156 in the discharge direction, the loaded sheet P can be partially lift up from the loading surface 151*a* reliably.

Further, the discharge unit is not limited to the discharge tray 68 having the loading surface 151*a* on which the discharged sheets P are loaded, and for example, the external feeding unit housing 19 can be used as the discharge unit, using an inclined surface at an upper part thereof as a loading surface.

Effects of Embodiment

As described above in detail, the discharge unit according to the present embodiment is a discharge unit that loads a sheet to be discharged thereon along a loading surface, and the loading surface is provided at a predetermined first inclination angle with respect to the discharge direction, so that the top of the discharged sheet comes into contact with the loading surface. The discharge unit includes a guide unit provided on the loading surface at a second inclination angle with respect to the loading surface, so as to partially lift up the loaded sheet from the loading surface.

By providing the guide unit in this manner, the next sheet is loaded in a state where the sheet loaded in the discharge unit is partially lifted up from the loading surface by the guide unit, thereby decreasing the contact area between the sheet loaded in the discharge unit and the newly discharged sheet. Therefore, friction and static electricity between sheets decrease, to prevent adsorption between the sheets. Accordingly, the sheet discharged by discharging means is reliably discharged, thereby preventing an occurrence of paper jam due to a collision of the rear end of the sheet with a subsequent sheet in a state where the rear end is left in a discharge port can be prevented. Accordingly, the sheet P can be discharged reliably.

Further, in the discharge unit according to the present embodiment, the guide unit may be provided at a central position in the direction orthogonal to the discharge direction, on the loading surface.

Accordingly, a loaded sheet can be partially lifted up from the loading surface, regardless of the size of a sheet.

If the guide unit is provided at the opposite ends in the direction orthogonal to the discharge direction on the loading surface, in a case of a sheet having an extremely narrow width (a length in the direction orthogonal to the discharge direction), the width of the sheet does not come into contact with the guide units at the opposite ends, thereby making it difficult to lift up the sheet properly. Meanwhile, by providing the guide unit in the central part in the direction orthogonal to the discharge direction, the sheet comes into contact with the guide unit, regardless of the width of the sheet. Therefore, the sheet can be lifted up properly.

Further, in the discharge unit according to the present embodiment, the guide unit may be provided on the loading surface on a downstream side of a position where the top of the discharged sheet comes into contact with the loading surface and on an upstream side of a top position of a sheet having a maximum size loadable on the loading surface.

Accordingly, the discharged sheet reaches the guide unit after the top of the sheet comes into contact with the loading surface. Therefore, the sheet P can easily form a space respectively on the upstream side and the downstream side of the guide unit, while being guided by the guide unit. Accordingly, the contact area between the sheet loaded on the discharge unit and a newly discharged sheet can be decreased.

Further, the discharge unit according to the present embodiment may be provided with the loading surface and the guide unit in such a manner that a sum of a discharge angle for discharging sheets, the first inclination angle, and the second inclination angle becomes such an angle that a sheet does not roll back.

The angle with which a sheet does not roll back is substantially less than 90 degrees with respect to the horizontal direction.

Accordingly, when the discharging means discharges a sheet obliquely upward to the discharge unit at a discharge angle with respect to the horizontal plane, it can be prevented that a discharged sheet inclines so as to be away from the loading surface of the discharge unit, and a sheet can be loaded properly on the loading surface.

Further, in the discharge unit according to the present embodiment, the first inclination angle and the second inclination angle may be an angle such that a sheet is not deformed by a contact with the loading surface.

The angle with which a sheet is not deformed by a contact with the loading surface is an angle larger than 0 degree and is generally within 30 degrees with respect to the discharge angle of the sheet.

Accordingly, an impact when a discharged sheet collides with the loading surface can be absorbed, and an impact when the top of a sheet transported along the loading surface collides with the guide unit can be absorbed. Therefore, smooth discharge of sheets can be performed without causing paper jam at the time of discharge.

Further, in the discharge unit according to the present embodiment, the guide unit may be provided slidably in the discharge direction of the sheets along the loading surface, with the height from the loading surface being adjustable.

By providing the guide unit slidably in the discharge direction of the sheets along the loading surface, in the case of a sheet having a large size, the guide unit can be moved to the downstream side, and in the case of a sheet having a small size, the guide unit can be moved to the upstream side. Accordingly, even if a sheet of any size is discharged, the loaded sheet can be partially lifted up from the loading surface, and thus the contact area between a sheet loaded on the discharge tray and a newly discharged sheet can be decreased.

Further, when the guide unit is provided with the height from the loading surface being adjustable, the degree of partially lifting up a sheet from the loading surface can be adjusted according to the stiffness (non-flexibility) of the sheet. Since the loaded sheet can be lifted up partially from the loading surface regardless of the stiffness (non-flexibility) of the sheet, the contact area between a sheet loaded on the discharge unit and a newly discharged sheet can be decreased.

Others

The present invention is not limited exactly to the above embodiment, and when the invention is actually implemented, it may be embodied in other specific forms while modifying the constituent elements without departing from the spirit of the invention. In addition, various inventions may be formed by appropriate combinations of a plurality of constituent elements disclosed in the above embodiment. For example, several constituent elements may be omitted from all the constituent elements described in the above embodiment.

This application claims priority based on Japanese Patent Application No. 2019-067369 filed on Mar. 29, 2019, and the entire content of this application is incorporated herein by reference.

REFERENCE SIGNS LIST

1 printing device
2 external feeding unit
3 printing device body
19 external feeding unit housing
31 internal feeding unit
32 printing unit
33 upper-surface transport unit
34 first discharge unit
35 reverse unit
36 second discharge unit
39 body housing
51 upward transport roller pair
52 horizontal transport roller pair
56 switching unit
57 discharge roller pair
58 discharge tray
59 discharge port
61 reverse roller pair
62 refeeding roller pair
63 switching gate
66 switching unit
67 discharge roller pair
68 discharge tray (discharge unit)
69 discharge port
151 tray body
151*a* loading surface

What is claimed is:

1. A discharge unit comprising:

a discharge roller configured to transport and discharge a sheet from a discharge port in a discharge direction; and a discharge tray having a central downstream-most edge orthogonal to the discharge direction and located in a central region of the discharge tray and an upstream-most edge orthogonal to the discharge direction, the discharge tray including:

a loading surface on which the discharged sheet is loaded, an entirety of the loading surface from an upstream end of the loading surface to a downstream end of the loading surface being sloped at a first inclination angle with respect to the discharge direction such that a top of the sheet in the discharge direction, which is being conveyed by the discharge roller, collides with the loading surface, and an inclination angle of the loading surface with respect to a horizontal plane being a first acute angle that is greater than an angle of the discharge direction with respect to the horizontal plane that is a second acute angle;

a bump cover in an erect plate shape, provided at the upstream end of the loading surface and extending toward the discharge port, and the bump cover being configured to bump against a bottom of the discharged sheet when the discharged sheet slides in a backward direction on the loading surface; and a guide provided on the loading surface at a second inclination angle with respect to the loading surface, so as to partially lift up the loaded sheet from the loading surface, the guide being provided on the loading surface on a downstream side of a position on the loading surface where the top of the sheet in the discharge direction, which is being conveyed by the discharge roller collides with the loading surface, and an upstream end of the guide being disposed above the discharge port and the upstream end of the loading surface being disposed below the discharge port, wherein the upstream end of the loading surface extends to the bump cover, and the entire guide is positioned upstream from the central downstream-most edge of the loading surface of the discharge tray in the discharge direction.

2. The discharge unit according to claim 1, wherein the guide is provided at a central position in a direction orthogonal to the discharge direction on the loading surface.

3. The discharge unit according to claim 1, wherein the guide is provided on an upstream side of a top position of a sheet having a maximum size loadable on the loading surface.

4. The discharge unit according to claim 1, wherein the loading surface and the guide are provided in such a manner that a sum of a discharge angle for discharging the sheet, the first inclination angle, and the second inclination angle becomes such an angle that the sheet does not roll back, and wherein the discharge angle is the angle of the discharge direction with respect to the horizontal plane.

5. The discharge unit according to claim 4, wherein the sum is less than 90 degrees.

6. The discharge unit according to claim 1, wherein the guide is provided on the loading surface so that a second sheet contacts the loaded sheet only at a contact area that extends along the guide, when the second sheet is being discharged.

7. The discharge unit according to claim 1, wherein the guide is configured to form a space between the sheet which is being conveyed by the discharge roller and the loading surface located on an upstream side of the guide, and a space between the sheet which is being conveyed by the discharge roller and the loading surface located on a downstream side of the guide.

8. The discharge unit according to claim 1, wherein each of the first inclination angle and the second inclination angle is larger than 0 degrees and within 30 degrees.

9. The discharge unit according to claim 1, wherein the discharge tray further includes a pair of side fences provided at the upstream end of the loading surface and arranged outside in a width direction of the discharged sheet, and the pair of side fences are movable in the width direction relative to the loading surface.

10. The discharge unit according to claim 9, wherein the pair of side fences includes a pair of stiffeners provided at a lowermost part of the pair of side fences, and the pair of stiffeners is configured to curve a portion of the discharged sheet so that a middle of the discharged sheet is located at a position lower than opposite ends in the width direction of the discharged sheet.

11. The discharge unit according to claim 1, wherein an upper space of the loading surface is opened upward.

12. The discharge unit according to claim 1, wherein the guide has an inclined surface with which the discharged sheet comes into contact, an entirety of the inclined surface being provided at the second inclination angle with respect to the loading surface.

13. The discharge unit according to claim 1, wherein the discharge roller is configured to discharge the sheet so as to allow the top of the sheet in the discharge direction to collide with a position on the loading surface on an upstream side of the position on the loading surface where the guide is provided, in cooperation with the first inclination angle at which the loading surface is sloped and the position on the loading surface where the guide is provided.

14. The discharge unit according to claim 1, further comprising a sheet discharge route from the discharge roller to the discharge tray defined by the discharge roller, the discharge tray, the first inclination angle, and the guide and guide position, wherein the sheet discharge route transports the top of the sheet in the discharge direction to collide with the loading surface at a position upstream of the guide, in cooperation with the first inclination angle at which the loading surface is sloped and the position on the loading surface where the guide is provided.

15. A method of operating the discharge unit recited in claim 1, comprising:

rotating the discharge roller; and discharging the top of the sheet in the discharge direction from the discharge roller onto the loading surface of the discharge tray to collide with the loading surface at a position upstream of the guide, in cooperation with the first inclination angle at which the loading surface is sloped and the position on the loading surface where the guide is provided.

* * * * *